US007898188B2

(12) United States Patent
Bühler et al.

(10) Patent No.: US 7,898,188 B2
(45) Date of Patent: Mar. 1, 2011

(54) ARRANGEMENT PROVIDED WITH A VOLTAGE CONVERTER FOR SUPPLYING VOLTAGE TO AN ELECTRICAL CHARGE AND ASSOCIATED METHOD

(75) Inventors: Tobias Bühler, Graz (AT); Thomas Jessenig, Klagenfurt (AT); Radek Gancarz, Debica (PL)

(73) Assignee: Austriamicrosystems AG, Unterpremstaetten (DE)

( * ) Notice: Subject to any disclaimer, the term of this patent is extended or adjusted under 35 U.S.C. 154(b) by 330 days.

(21) Appl. No.: 11/908,723

(22) PCT Filed: Mar. 17, 2006 (Under 37 CFR 1.47)

(86) PCT No.: PCT/EP2006/002493

§ 371 (c)(1), (2), (4) Date: May 29, 2008

(87) PCT Pub. No.: WO2006/097329

PCT Pub. Date: Sep. 21, 2006

(65) Prior Publication Data

US 2009/0179589 A1 Jul. 16, 2009

(30) Foreign Application Priority Data

Mar. 18, 2005 (DE) ..... 10 2005 012 663

(51) Int. Cl.
*G05F 1/00* (2006.01)
*G09G 3/32* (2006.01)

(52) U.S. Cl. ..... 315/291; 315/185 S; 315/312; 315/247; 315/224; 345/82; 345/102; 345/212

(58) Field of Classification Search ..... 315/185 S, 315/200 A, 247, 246, 224, 225, 209 R, 291, 315/297, 307–326; 345/82, 102, 211–214, 345/204, 207; 327/536, 535, 530, 538, 540
See application file for complete search history.

(56) References Cited

U.S. PATENT DOCUMENTS 6,466,188 B1 10/2002 Cato (Continued)

FOREIGN PATENT DOCUMENTS

DE 198 41 490 3/2000

(Continued)

OTHER PUBLICATIONS

"480mA White LED 1x/1.5x/2x Charge Pump for Backlighting and Camera Flash" Maxim Integrated products, USA, 2004, No. 19-3326; Rev 0; Jun. 2004, pp. 1-14.

(Continued)

*Primary Examiner*—Tuyet Thi Vo
(74) *Attorney, Agent, or Firm*—Fish & Richardson P.C.

(57) ABSTRACT

A method includes a voltage converter outputting an output voltage that is based on an input voltage and on a first multiplication factor, determining a predicted current sink voltage based on a new multiplication factor obtained from a set of selectable values, based on a signal derived from the input voltage, based on a load voltage across an electrical load, and based on a correction voltage. The method also includes comparing a predicted current sink voltage with a predetermined threshold value and outputting the new multiplication factor to a control input of the voltage converter if the predicted current sink voltage exceeds the predetermined threshold value.

22 Claims, 5 Drawing Sheets

U.S. PATENT DOCUMENTS

| | | | | |
|---|---|---|---|---|
| 2003/0235062 | A1 | 12/2003 | Burgyan et al. | |
| 2005/0231127 | A1* | 10/2005 | Yamamoto et al. | 315/224 |

FOREIGN PATENT DOCUMENTS

| | | |
|---|---|---|
| DE | 100 40 154 | 1/2003 |
| EP | 1 185 147 | 3/2002 |
| JP | 2001-215913 | 8/2001 |
| JP | 2003-348821 | 12/2003 |
| JP | 2005-318787 | 11/2005 |
| JP | 2006-254641 | 9/2006 |

OTHER PUBLICATIONS

Written Opinion for PCT/EP2006/002493.
Search Report for PCT/EP2006/002493.
International Preliminary Exam Report with translation for PCT/EP2006/002493.
Examination report dated Oct. 5, 2010 recieved for corresponding application JP 2008-501239.
English translation of Examination report dated Oct. 5, 2010 received for corresponding application JP 2008-501239.

* cited by examiner

ARRANGEMENT PROVIDED WITH A VOLTAGE CONVERTER FOR SUPPLYING VOLTAGE TO AN ELECTRICAL CHARGE AND ASSOCIATED METHOD

TECHNICAL FIELD

This patent application relates to an arrangement with a voltage converter for supplying power to an electrical load, and to a method for automatically setting an arrangement with a voltage converter for supplying power to an electrical load. The arrangement can be used to power light emitting diodes, LEDs for short, using a voltage converter such as a charge pump.

BACKGROUND

Normally, voltage converters, also called direct current/direct current converters, DC/DC converters for short, are used to convert a low voltage to a higher voltage. Often, the output voltage to input voltage ratio can be set by selecting a multiplication factor. This is generally done using a few discrete values. By way of example, voltage converters are used to produce flashes with an LED and in the backlight for a liquid crystal display.

Appliances in which voltage converters are used are often portable and are battery operated. They thus do not have a constant voltage at the input for the device to be powered, such as an LED. The operation of the LED needs to be assured independently of a removable input voltage however. For this reason, voltage converters are frequently operated with circuitry for setting the multiplication factor of the voltage converter.

By way of example, the multiplication factor is set by an external microcontroller with an analog/digital converter. Various electrical variables, such as the input and output voltages of the voltage converter and the currents in an LED or in parallel-connected LEDs, are converted into digital signals for this purpose. The drawback of the microcontroller circuit is the high level of complexity. While the microcontroller is performing other tasks, it cannot regulate the voltage converter.

The datasheet "480 mA white LED 1×/1.5×/2× Charge Pump for Backlighting and Camera Flash", MAX1576 module, No. 19-3326; Rev 0; 6/04, Maxim Integrated Products, USA describes a module which contains a voltage converter and is used to connect up to eight LEDs. The current in the LEDs is derived individually via eight inputs of this module which are routed to constant current regulators, shown as FET current sources in the circuit diagram. The MAX1576 module takes account of the voltages at the input and output of the voltage converter and a voltage $U_{LED}$ when setting the multiplication factor. If one of the eight inputs used for connecting the LEDs is connected to ground inadvertently or on account of a fault, the MAX1576 module sets the output voltage to approximately 5 V. This increases the power consumption.

SUMMARY

Described herein is an arrangement with a voltage converter which has an input to which an input voltage can be supplied, which has an output connected to a first connection of a series circuit, comprising means for connecting an electrical load and a current sink, and whose output voltage has a dependency on the input voltage and on a present multiplication factor, the series circuit having a second connection connected to a reference potential connection, a prediction unit which has a first sampling input to which a signal derived from the input voltage can be supplied and which is set up to determine a predicted current sink voltage on the basis of a new multiplication factor from a set of selectable values of the multiplication factor, on the basis of a load voltage dropping across the electrical load which is to be connected, a correction voltage for the voltage converter and on the basis of the signal derived from the input voltage, and a comparator which is coupled to the prediction unit for supplying the predicted current sink voltage, which has an output connected to a control input of the voltage converter for setting the multiplication factor and which is set up to compare the predicted current sink voltage with a prescribed threshold value and to output the new multiplication factor if the predicted current sink voltage exceeds the prescribed threshold value.

The output voltage produced by the voltage converter drops across the electrical load and the current sink, the electrical load being connected either to the voltage converter or to the reference potential connection. To determine the voltage across the electrical load, called the load voltage, there is provided in both cases a connection to the node of the series circuit which is situated between the electrical load and the current sink. In the first case there is a second connection to the output voltage from the voltage converter, and in the second case there is a second connection to the reference potential connection.

A voltage across the current sink, called the current sink voltage, can be determined by deducting the load voltage from the output voltage. The predicted current sink voltage is a current sink voltage which drops across the current sink for the new multiplication factor from a set of selectable values of the multiplication factor. A present current sink voltage is accordingly a voltage which drops across the current sink at present, that is to say for the present multiplication factor.

The current sink keeps the current through the electrical load, called the load current, constant. If the output voltage from the voltage converter rises then the present current sink voltage rises accordingly. This prevents the voltage across the load and the current through the load from being increased. The electrical power which the current sink consumes at present is the present current sink voltage multiplied by the load current. For this reason, a current sink voltage which is as low as possible is advantageous.

The correction voltage $U_{CORR_NEW}$ is obtained from the load current $I_{out}$ and an internal resistance of the voltage converter $R_{CP_NEW}$:

$$U_{CORR_NEW}=f(I_{out}; R_{CP_NEW}) \quad \text{Equation 1}$$

The internal resistance $R_{CP}$ is in turn a function of the multiplication factor m. In the case of the prediction, the predicted internal resistance $R_{CP_NEW}$ is thus a function of the new multiplication factor $m_{NEW}$.

The prediction unit determines the predicted current sink voltage for the new multiplication factor and in so doing takes account of the new multiplication factor, the load voltage, the correction voltage and the input voltage or a signal derived from the input voltage. The comparator passes the new multiplication factor to the voltage converter if the predicted current sink voltage is higher than the prescribed threshold value.

In one development, the prediction unit calculates the predicted current sink voltage on the basis of a formula derived as below. The network equation for the output voltage from the voltage converter gives:

$$U_{OUT_PRES}=U_{IN}\cdot m_{PRES}-U_{CORR_PRES}=U_{LOAD}+U_{SINK_PRES} \quad \text{Equation 2}$$

where $U_{OUT_PRES}$ is the present output voltage and $U_{IN}$ is the input voltage of the voltage converter, $m_{PRES}$ is the present multiplication factor, $U_{CORR_PRES}$ is the present correction voltage for taking account of the load-dependent drop in the output voltage, $U_{LOAD}$ is the load voltage and $U_{SINK_PRES}$ is the present current sink voltage for the present multiplication factor $m_{PRES}$. In an ideal voltage converter, $U_{CORR}=0$ V would be true. This is possible without a load current. As the load current increases, however, the correction voltage rises significantly.

Since the current through the electrical load is kept constant by the current sink in a first approximation, the load voltage is constant in a first approximation. In the short term, the input voltage does not change either. For $m_{NEW}$, the following thus applies:

$$U_{OUT_NEW}=U_{IN}\cdot m_{NEW}-U_{CORR_NEW}=U_{LOAD}+U_{SINK_NEW} \quad \text{Equation 3}$$

where $U_{OUT_NEW}$ is the new output voltage from the voltage converter, $m_{NEW}$ is the new multiplication factor, $U_{CORR_NEW}$ is the correction voltage for the new multiplication factor and $U_{SINK_NEW}$ is the predicted current sink voltage.

The following is obtained for the predicted current sink voltage $U_{SINK_NEW}$:

$$U_{SINK_NEW}=U_{IN}\cdot m_{NEW}-U_{LOAD}-U_{CORR_NEW} \quad \text{Equation 4}$$

The prediction unit passes the current sink voltage $U_{SINK_NEW}$ predicted using Equation 4 to the comparator. If $U_{SINK_NEW}$ is higher than the prescribed threshold value $U_{MIN}$ then $m_{NEW}$ is the new multiplication factor for which the load can be supplied with sufficient power. The comparator forwards the new multiplication factor $m_{NEW}$ to the voltage converter, which is operated thereby.

Advantageously, the prediction unit and the comparator are designed using Equation 4, since this calculation can be implemented using particularly simple analog circuits.

The prediction unit can be supplied with a signal derived from the input voltage for this calculation.

The correction voltage can be ascertained by meteorological characterization as a function of the load current and the internal resistance or the multiplication factor. Advantageously, the correction voltage can be determined as a function of the load current and the internal resistance or the multiplication factor by simulating the circuit of the voltage converter, since the complexity for the simulation can be kept lower. The simulation can be performed when the voltage converter is developed. It can therefore be done before the arrangement is started up. The result of the simulation may be stored in a memory, such as a table memory.

The load current in turn can be determined using an additional, precisely known resistance in the load circuit and detection of the voltage dropping across this resistance, so that the correction voltage can be calculated. If a load current is set permanently in the semiconductor component or a load current is prescribed externally as a value, the correction voltage can advantageously be calculated without measuring the load current.

It is advantageous, as it is associated with relatively low complexity, does not consume additional power and can be implemented with relatively high accuracy, to sample the input voltage directly.

In one development, the new current sink voltage can advantageously be calculated from a load voltage which is set permanently in the semiconductor component or a load voltage which is prescribed externally as a value without measuring the load voltage.

In a development for a plurality of loads to be operated in parallel, provision may be made for at least one further series circuit, comprising means for connecting a further electrical load and a further current sink, to be provided. The further series circuit has a first connection connected to the output of the voltage converter and has a second connection connected to the reference potential connection in parallel with the first series circuit.

As in the case of a single load, the further electrical load is connected to the voltage converter or to the reference potential connection. Advantageously, the further electrical load is connected up like the electrical load, since the complexity for designing an implementation is reduced in this way.

Since the correction voltage is dependent on the load current appearing at the output of the voltage converter, when there are a plurality of loads to be operated in parallel the sum of the load currents through the electrical load and the at least one further electrical load needs to be taken into account for calculating the correction voltage. The voltage converter has a finite set of selectable values for the multiplication factor. If the predicted current sink voltage for a plurality of new multiplication factors is higher than the prescribed threshold value then although the electrical load is supplied with sufficient power for all multiplication factors the magnitude of the voltage drop across the current sink differs. This reduces the efficiency of the utilization of the power. The arrangement is therefore advantageously designed such that the lowest of the multiplication factors is set for which the predicted current sink voltage for all electrical loads is respectively higher than the prescribed threshold value associated with the electrical load.

In one embodiment, the comparator is designed to select a higher multiplication factor from the set of selectable values than the present multiplication factor if and so long as the present current sink voltage for at least one electrical load is lower than a prescribed threshold value associated with the electrical load. The apparatus is set up to select a higher multiplication factor until the present current sink voltage for each electrical load is higher than a prescribed threshold value associated with the electrical load. This applies only for as long as the input voltage has not fallen to the extent that the output voltage is too low even for the highest multiplication factor from the set of selectable values.

The calculation of a predicted current sink voltage in conjunction with the ascertainment of the lowest multiplication factor for which the current sink voltage is higher than the threshold value results in the same value for the multiplication factor as the recently described procedure. One advantage is that the arrangement for the latter procedure requires even lower circuit complexity.

Also described herein is an arrangement in which the comparator is designed to identify a faulty series circuit. The series circuit comprises an electrical load, connected to the means for connecting an electrical load, and the current sink. Such a fault may arise from a current interruption in the load or in the connections of the electrical load or in the current sink itself. The series circuit is identified as being faulty if the present current sink voltage for the highest multiplication factor from the set of selectable values is lower than a prescribed threshold value associated with the electrical load.

The comparator may include a means for storing the information regarding which series circuit is identified as being faulty. The comparator may also be designed to forward this information to another module, for example to a microcontroller, processor core or display.

The arrangement may also be of a nature such that the comparator is designed to omit series circuits identified as being faulty when ascertaining the multiplication factor or during further cycles for identifying a fault. Advantageously, the multiplication factor is thus not set to the highest value although the present current sink voltage is below the prescribed threshold value on account of an interruption as a fault.

The arrangement may be designed such that the current sinks can be disconnected and the comparator has control outputs which are connected to the current sinks for the purpose of disconnecting the current sink of the series circuit identified as being faulty. The control outputs of the comparator are, to this end, connected to the current sinks by control lines. These control lines can advantageously also be used to turn on and disconnect electrical loads according to the tasks. For example, light emitting diodes which are intended to emit a brief flash are, to this end, turned on briefly by the control line. The comparator may include a means for storing information regarding which series circuit needs to be turned on. The comparator may also be designed to receive this information from another module.

The control line can be routed to an arrangement comprising a plurality of electrical loads together, particularly when the loads in this arrangement together perform a task. Advantageously, however, each current sink has a dedicated control line connected to a dedicated control output of the comparator so that only one of the electrical loads is disconnected if a series circuit is faulty.

The aforementioned means and associated methods can be used to determine the multiplication factor on the basis of a prescribeable time frame. The comparator may be designed such that the determination of the multiplication factor is triggered by changes in the voltages in the arrangement or when series circuits are disconnected or connected.

The comparator is advantageously designed to identify a fall in the input voltage and to trigger a prediction regarding whether a higher multiplication factor than the present one needs to be set. Even when an electrical load is connected by means of the associated current sinks being turned on, it is possible to ascertain this because the connection results in an increase in the entire load current and thus in the correction voltage. In both cases, the output voltage falls. It is therefore advantageously possible for the fall in the output voltage also to serve as a trigger for a prediction regarding whether a higher multiplication factor than the present one needs to be selected.

The comparator is advantageously designed to identify a rise in the input voltage and to trigger the prediction regarding whether a lower multiplication factor than the present one needs to be set. Even when an electrical load is disconnected, it is possible to ascertain this. In both cases, the output voltage rises. The rise in the output voltage can therefore also advantageously serve as a trigger for a prediction regarding whether a lower multiplication factor than the present one needs to be selected. This serves for energy efficiency.

In one embodiment, the voltage converter is a charge pump. Charge pumps can be designed and implemented such that they have a plurality of selectable multiplication factors and hence can output various output voltages with efficient use of energy. By way of example, the input voltage for the voltage converter can be output by a battery, solar cell, generator, piezo element or charged capacitor.

Electrical values for the current sinks, such as the prescribed load current and the prescribed threshold value, can be set permanently in the arrangement. In line with one development, these values can be set by control lines or components which can be connected to the arrangement externally, such as variable resistors or capacitors, or digitally by connection of inputs. The means used for setting the values in one development may also be memories.

Similarly, in one development, it is also possible to provide further memories for other information suitable for the calculations, such as a memory for the new and present multiplication factors, for the input and output voltages and the past values of the input and output voltages, for the load currents, for the sum of all load currents, for the load voltages, for the threshold values, for the present current sink voltages and the predicted current sink voltages. The values required for determining the correction voltage from the sum of all load currents and from the multiplication factor may be stored in a memory. The memory may comprise a table memory.

For values which do not change during operation but rather are constant for an application, such as the set of selectable values of the multiplication factor, the prescribed threshold values, the prescribed load currents, the prescribed load voltages and the values required for determining the correction voltage from the sum of all load currents and from the multiplication factor, the memories used may also be nonvolatile memories. Otherwise, these memories can be filled with information by a superordinate unit via a line or a bus when the appliance is turned on.

Such memories may be implemented in the comparator, which transfers the values to the prediction unit as soon as the prediction unit requires them.

The arrangement may be implemented by virtue of the comparator and the prediction unit being in the form of two semiconductor components, or by virtue of the comparator and the prediction unit together being in the form of one semiconductor component, or by virtue of the comparator and the prediction unit and the current sinks together being in the form of one semiconductor component, or by virtue of the comparator and the prediction unit and the voltage converter together being in the form of one semiconductor component, or by virtue of the comparator and the prediction unit, the current sinks and the voltage converter together being in the form of one semiconductor component, using integrated circuitry.

Also described herein is a method for setting an arrangement with a voltage converter for supplying power to an electrical load, having the following steps:

- the voltage converter has a first input connected to an input voltage and has an output connected to a first connection of a series circuit, comprising means for connecting the electrical load and a current sink, the voltage converter outputting an output voltage which is dependent on the input voltage and on a present multiplication factor,
- the series circuit has a second connection connected to a reference potential connection,
- a predicted current sink voltage is determined on the basis of a new multiplication factor from a set of selectable values of the multiplication factor, on the basis of a signal derived from the input voltage, on the basis of a load voltage dropping across the electrical load which is to be connected and on the basis of a correction voltage for the voltage converter, and the predicted current sink voltage is compared with a prescribeable threshold value and the new multiplication factor is output to a control input of the voltage converter, if the predicted current sink voltage exceeds the prescribeable threshold value.

The predicted current sink voltage is a voltage which drops across the current sink for the new multiplier. By contrast, a present current sink voltage is a voltage which drops across the current sink at present, that is to say for the present multiplication factor.

The method can be developed, as described above, by virtue of the arrangement identifying a series circuit as being faulty if the present current sink voltage for the highest multiplication factor from the set of selectable values of the multiplication factor remains below the prescribeable threshold value associated with the electrical load.

If a plurality of series circuits are powered by the voltage converter, the output voltage is reduced in comparison with the value with just one powered series circuit on account of the load current. To eliminate the influence of this reduction, arrangements having more than one series circuit therefore advantageously involve a fault being ascertained by virtue of each series circuit being individually examined for a fault by using control lines to disconnect the series circuits which are currently not being examined.

With a plurality of series circuits, a search for a fault can advantageously be triggered whenever, during operation of the arrangement, the largest from a set of selectable values of the multiplication factor is set as the multiplication factor and the present current sink voltage does not reach the prescribeable threshold value for all loads. This prevents a series circuit from being identified as being faulty merely on account of an output voltage having fallen.

On the basis of this triggering condition or on the basis of a prescribeable time frame, the arrangement can advantageously change to an examination mode in which the individual series circuits are examined sequentially.

The search for a fault can be performed by virtue of the multiplication factor being increased from the lowest value to the highest value from the set of selectable multiplication factors. This advantageously does not increase the loading on the series circuit abruptly.

In respect of the method and further developments of the method, reference is made to the preceding description of the manner of operation and to the claims.

In summary, the proposed principle has the following advantages:

very high efficiency for the power used, simple usability; there is no need for additional external control of the voltage converter, the required circuit can be implemented with analog circuits; there is therefore no need to use a microcontroller or a processor core, the properties of the load do not need to be known when the arrangement is designed and manufactured, series circuits identified as being faulty do not influence the setting of the multiplication factor.

Further details and advantageous refinements of the proposed arrangement and of the proposed method are the subject matter of the subclaims.

Embodiments are explained in more detail below with reference to the figures.

DETAILED DESCRIPTION

Figure 1:
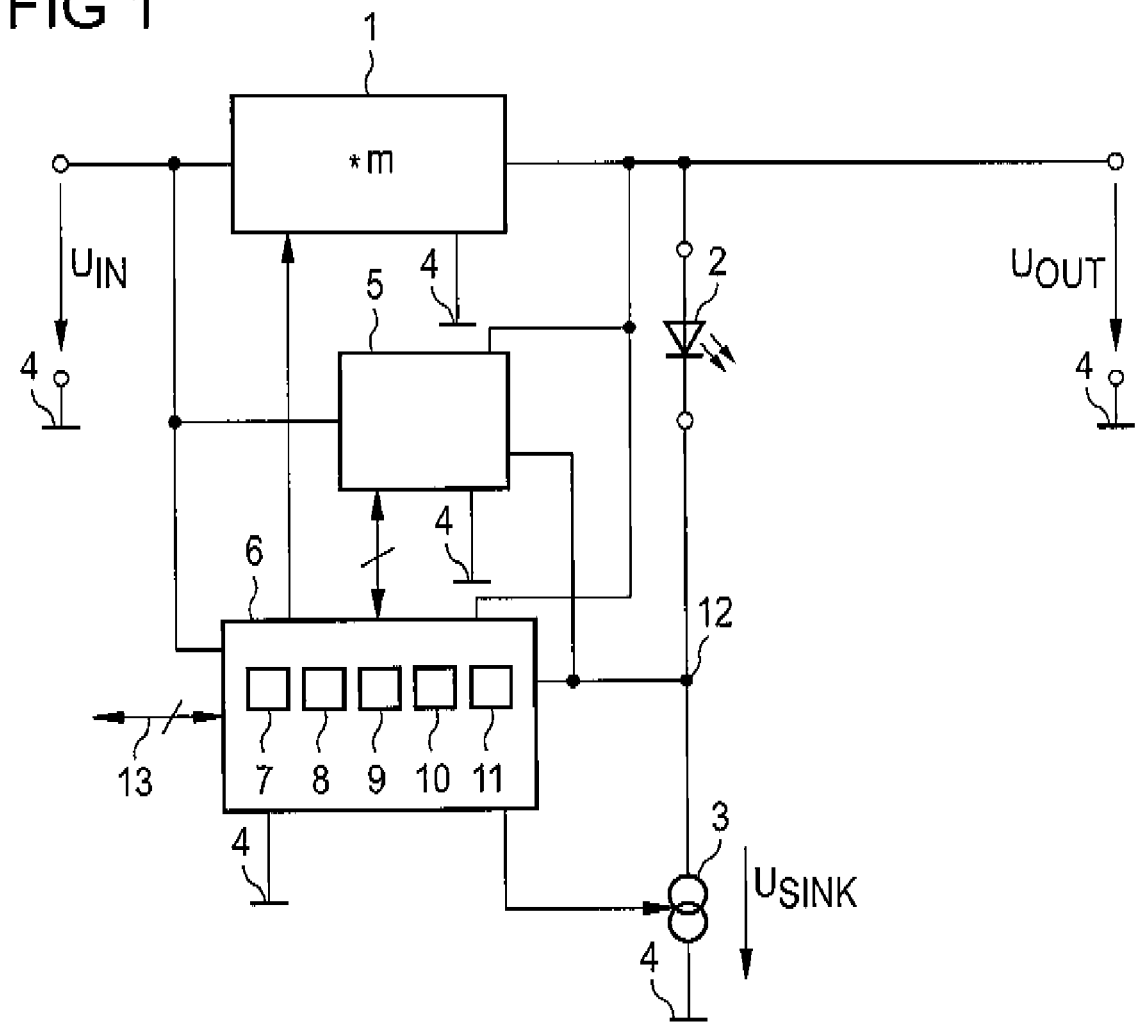
FIG. 1 shows a block diagram of an exemplary embodiment of the arrangement with a voltage converter for supplying power to an electrical load.

FIG. 1 shows a voltage converter 1 which can have a first input connected to an input voltage $U_{IN}$ and which has an output connected to a series circuit. The voltage $U_{OUT}$ at the output of the voltage converter 1 has a dependency on the voltage of the first input $U_{IN}$ and on a multiplication factor m. The series circuit comprises connection of an electrical load 2 and a current sink 3. In FIG. 1, the electrical load 2 is connected to the output of the voltage converter 1 and the current sink 3 is connected to the reference potential connection 4.

FIG. 1 also shows a prediction unit 5 and a comparator 6, which both have a first sampling input connected to a first connection node 12 of the current sink 3. The prediction unit 5 samples the input voltage $U_{IN}$ and the output voltage $U_{OUT}$ of the voltage converter 1 and is connected to the reference potential connection 4. The prediction unit 5 ascertains a predicted voltage for the current sink 2. A plurality of lines link the prediction unit 5 and the comparator 6 to one another.

The comparator 6 is connected to the reference potential connection 4, to the output of the voltage converter 1 and, by a control line, to the current sink 3. This connection is used for turning the current sink 3 on and off in the event of a fault in the series circuit. The comparator 6 compares the predicted current sink voltage with a prescribeable threshold value and in this way ascertains the new multiplication factor. It is designed to set the multiplication factor of the voltage converter 1 and is therefore connected to the voltage converter 1. The effect achieved by this is that the voltage $U_{SINK}$ dropping across the current sink 3 is higher than a threshold value.

To identify a falling or rising input voltage $U_{IN}$ or a falling or rising output voltage $U_{OUT}$, the comparator 6 is also connected to the first input of the voltage converter 1.

The comparator 6 may have a memory for the information about the series circuit identified as being faulty and also the series circuit 7 which is off, for the selectable values of the multiplication factor 8, for the prescribeable threshold value 9, for the prescribeable load current and the load voltage 10 and memories for the new and present multiplication factors, the input and output voltages and also the past input and output voltages, the present, predicted and past current sink voltages and the values 11 required for determining the correction voltage from the load current and from the multiplication factor. A bus connection 13 provides the option of forwarding information to a superordinate unit and of obtaining information from the latter.

The connection between the prediction unit 5 and the output of the voltage converter 1, the connections between the comparator 6 and the input and the output of the voltage converter 1 and also the first connection node 12 of the current sink 3 may be dispensed with in alternative refinements. Similarly, the connection between the comparator 6 and the current sink 3 by a control line and also the bus connection 13 may be dispensed with in alternative refinements.

Figure 2:
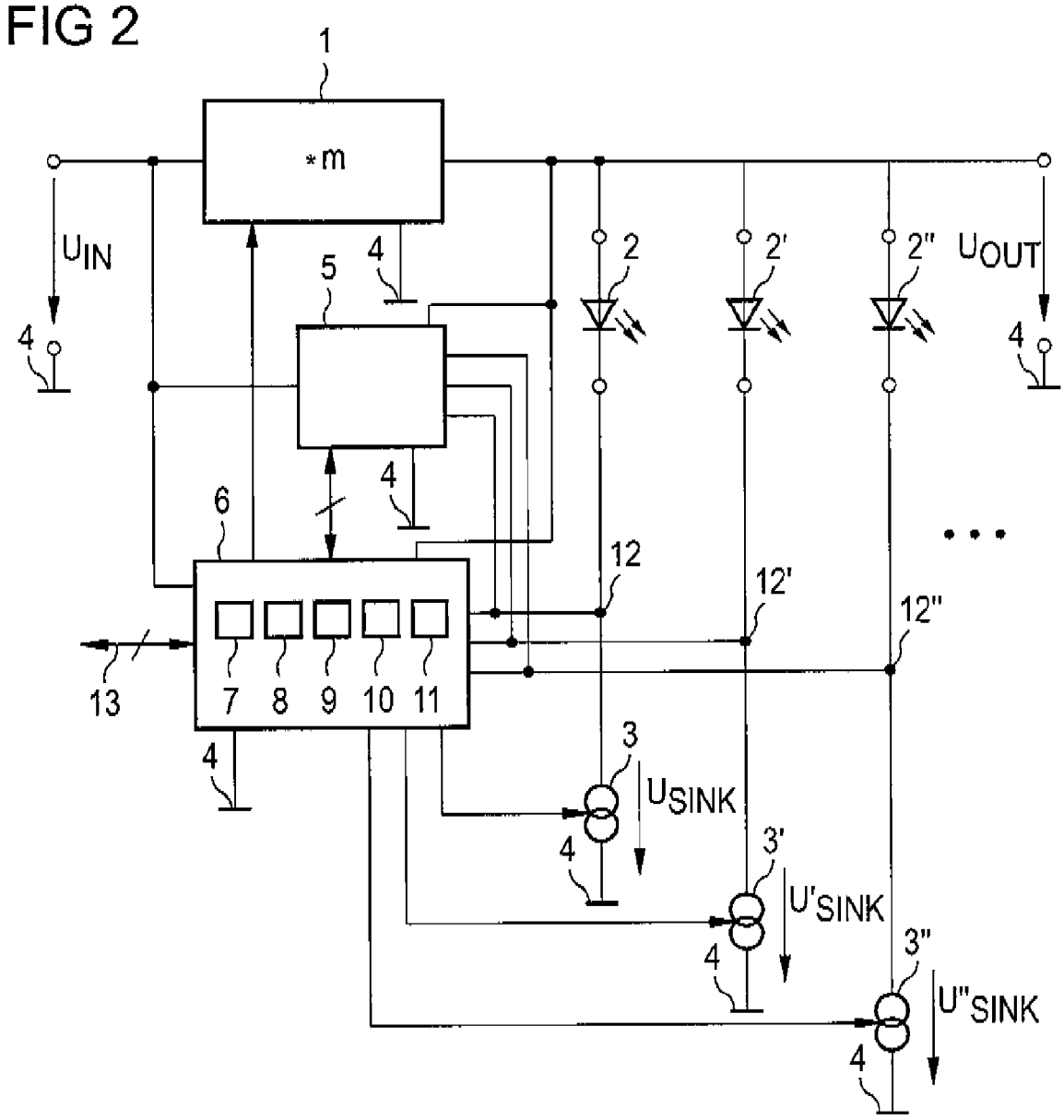
FIG. 2 shows a block diagram of a second exemplary embodiment of the arrangement with a voltage converter, namely for powering a plurality of electrical loads.

FIG. 2 shows a block diagram of a second exemplary embodiment of the arrangement with a voltage converter 1, namely for powering a plurality of loads 2, 2', 2".

The voltage converter 1 has an output connected to two or more series circuits. The series circuits comprise means for connecting electrical loads 2, 2', 2" and current sinks 3, 3', 3". In similar fashion to FIG. 1, the current sinks 3, 3', 3" in FIG. 2 are connected to the reference potential connection 4 and the electrical loads 2, 2', 2" are connected to the output of the voltage converter 1.

FIG. 2 also shows a prediction unit 5 and a comparator 6, which both have sampling inputs connected to the respective first node (12, 12', 12") of the current sinks 3, 3', 3".

The comparator 6 has further outputs connected to the current sinks 3, 3', 3" by a plurality of control lines. This connection is used for turning the current sinks 3, 3', 3" on and off, for example if there is a fault in the series circuit.

The comparator 6 may have a memory for the information about the series circuits identified as being faulty and also the series circuits 7 which are off for the selectable values of the multiplication factor 8, for the prescribeable threshold values 9, for the prescribeable load currents and the load voltages 10 and memories for the new and present multiplication factors, the input and output voltages and also the past input and output voltages, the present, predicted and past current sink voltages 11.

For the further connections and the manner of operation in FIG. 2, what has been stated for FIG. 1 applies. The new multiplication factor is set such that the voltages $U_{SINK}$, $U'_{SINK}$, $U''_{SINK}$ dropping across the current sinks 3, 3', 3" for each series circuit are higher than a prescribeable threshold value associated with the respective load 2, 2', 2".

Figure 3:
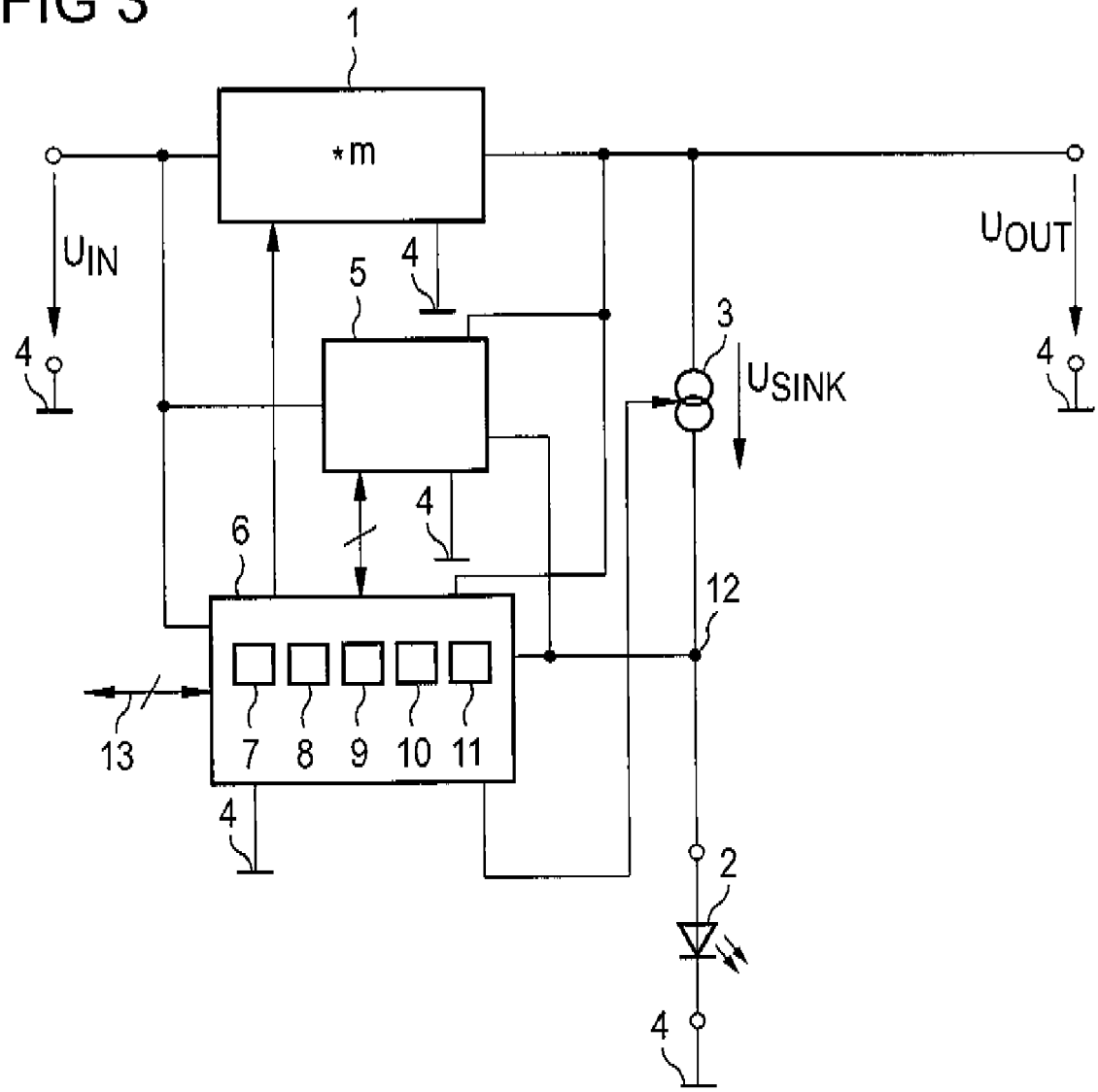
FIG. 3 shows a block diagram of a third exemplary embodiment of the arrangement with a voltage converter for powering an electrical load, where the electrical load is connected to the reference potential connection, unlike in FIG. 1.

FIG. 3 shows a block diagram of a third exemplary embodiment of the arrangement with a voltage converter 1 for powering an electrical load 2 in a departure from FIG. 1, the electrical load 2 being connected to the reference potential connection 4, unlike in FIG. 1.

In FIG. 3, a connection from the prediction unit 5 and the comparator 6 to the output of the voltage converter 1 is used to allow determination of the voltage $U_{SINK}$ across the current sink 3. For the further connections and the manner of operation in FIG. 3, what has been stated for FIG. 1 applies.

Figure 4:
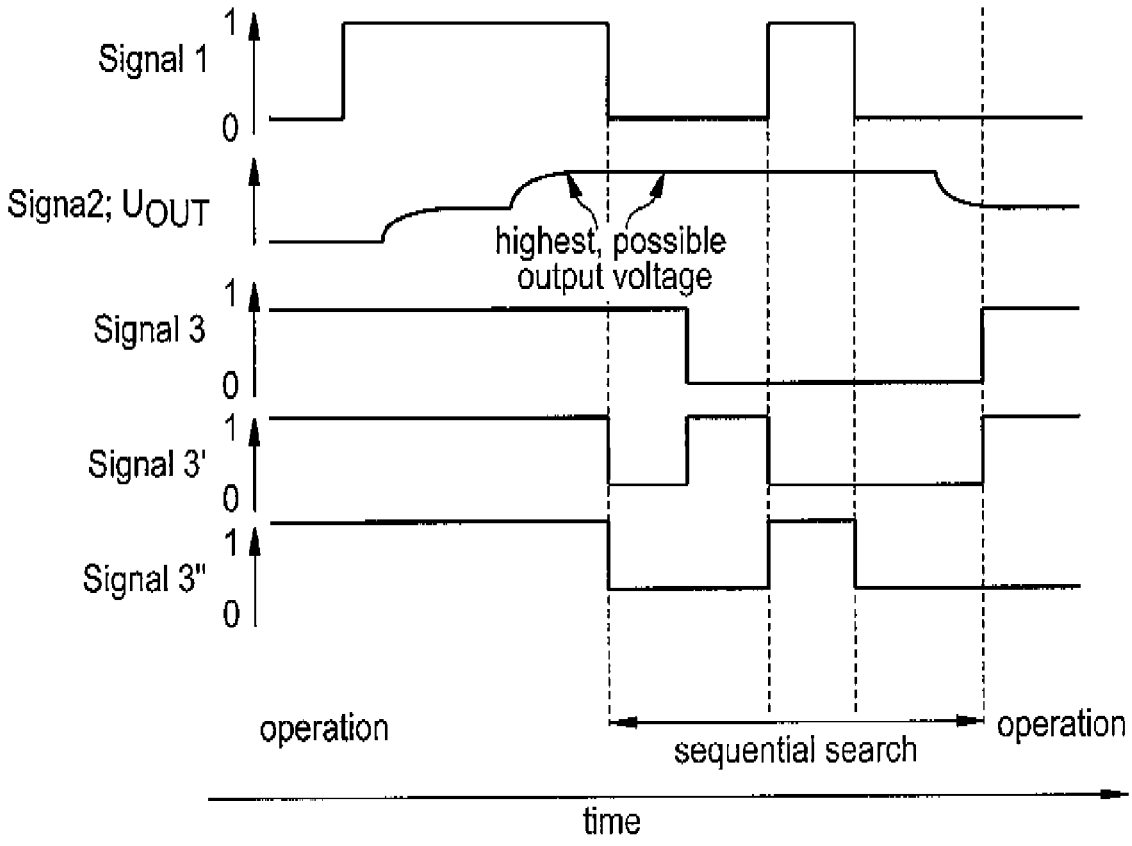
FIG. 4 shows an exemplary signal profile for the examination of series circuits for faults.

FIG. 4 shows a signal profile for the examination of series circuits for faults, the series circuit comprising an electrical load, connected to the means for connecting an electrical load, and a current sink.

A logic level 1 in signal 1 in FIG. 4 represents the situation in which the next highest multiplication factor needs to be selected. At a logic level 0, the multiplication factor remains at a constant value.

The signal 2 shows the output voltage $U_{OUT}$ from the voltage converter 1, which rises so long as the signal 1 is at 1. In the example shown, an even higher multiplication factor from the set of selectable multiplication factors is selected during operation (signal 1 is at 1) and hence the output voltage $U_{OUT}$ (signal 2) rises to the maximum possible value. Since signal 1 is still at 1, this triggers examination of the series circuits for a fault.

The signal 3 is 1 if the current sink 3 is on and is 0 if the current sink 3 is off. During operation, the current sink 3 is on. In the first phase of the sequential examination, the current sink 3 is likewise on, specifically on its own. The signal 1 is 0, that is to say that the voltage $U_{SINK}$ across the current sink 3 is higher than a threshold value. This means that the series circuit to which the current sink 3 belongs does not have a fault, such as an interrupted line.

While the further series circuits are being examined, the signal 3 is at 0, that is to say that the current sink 3 disconnects this series circuit. Following the examination, this signal is set to 1 again for the operation of the electrical load 2, since no fault has been found for the associated series circuit.

The signal 3' and the signal 3" are 1 during operation, that is to say that the current sinks 3' and 3" are on. In the first phase of the sequential examination, the current sinks 3' and 3" are off. They are subsequently turned on sequentially. Current sink 3' and the associated series circuit behave like current sink 3 and the associated series circuit during the examination.

During the examination of the series circuit with the electrical load 2" and the current sink 3", the signal 1 changes to 1, that is to say that even for the highest multiplication factor the voltage $U'_{SINK}$ across the current sink 3" is lower than the threshold value associated with the current sink 3". In the series circuit with the electrical load 2" and the current sink 3", a fault is thus identified.

The current sink 3" is therefore turned off during operation, while the other two current sinks 3 and 3' are in operation. The output voltage $U_{OUT}$ (signal 2) can now be lowered and the power consumption is reduced.

Figure 5:
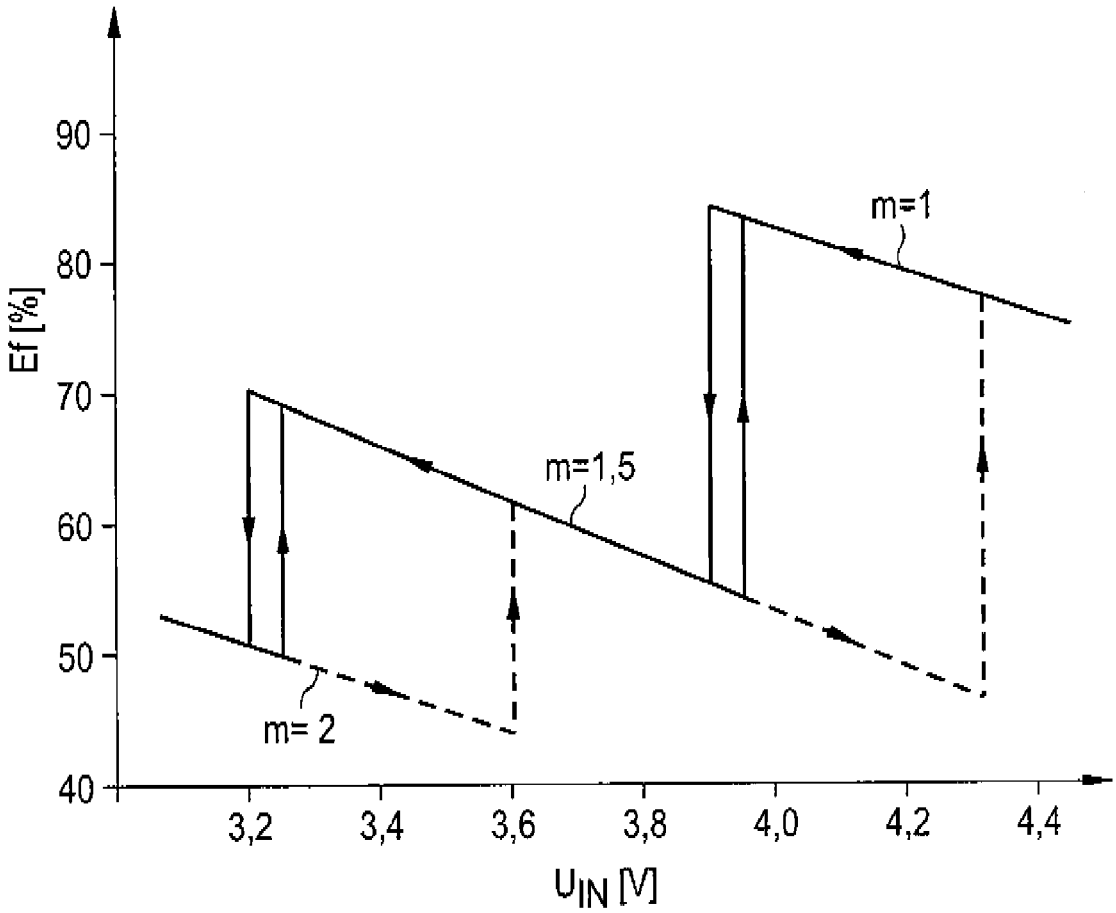
FIG. 5 shows an exemplary dependency of an efficiency of the arrangement with a voltage converter on an input voltage.

FIG. 5 shows an example of a dependency of an efficiency Ef of the arrangement with the voltage converter 1, based on the proposed principle, on the input voltage $U_{IN}$ using the solid lines.

If the input voltage $U_{IN}$ in the example shown in FIG. 5 falls from 4.4 V to 3.9 V, the output voltage $U_{OUT}$ and hence the current sink voltage $U_{SINK}$ likewise fall and the efficiency Ef of the power consumption rises. If the current sink voltage $U_{SINK}$ falls to the threshold value, the comparator 6 sets the next highest multiplication factor m. In this example, the voltage converter 1 is changed over from a multiplication factor m=1 to the multiplication factor m=1.5. The ratio of the input voltage $U_{IN}$ to the output voltage $U_{OUT}$ thus changes from 1:1 to 1:1.5, so that an adequate output voltage $U_{OUT}$ is provided. If the input voltage falls from 3.9 V further to values below 3.2 V, the comparator 6 sets the next highest multiplication factor m=2, so that the ratio of the input voltage $U_{IN}$ to the output voltage $U_{OUT}$ is changed over to 1:2.

With a rising input voltage $U_{IN}$, the prediction unit 5 ascertains the predicted current sink voltage $U_{SINK_NEW}$. The comparator 6 compares the predicted current sink voltage $U_{SINK_NEW}$ with the threshold value. If the predicted current sink voltage $U_{SINK_NEW}$ is higher than the threshold value then the multiplication factor m is reduced to the next lowest settable value. In the event of a rise in the input voltage $U_{IN}$ from 3.1 V, for example, to 3.25 V, the voltage converter is switched from m=2 to m=1.5, which increases the efficiency Ef of the arrangement from approximately 50% to 70%.

For the purpose of comparison, a dashed line shows a possible dependency of the efficiency of a conventional arrangement, which is not implemented on the basis of the proposed principle, on the input voltage $U_{IN}$. In this example, a difference is shown particularly when the input voltage $U_{IN}$ is rising and hence when the multiplication factor m is reduced. In such an arrangement, changeover from m=2 to m=1.5 would occur only upon a rise in the input voltage $U_{IN}$ to 3.6 V, for example, so that the efficiency of the arrangement would in the meantime have fallen to approximately 45%.

The invention claimed is:

1. An arrangement comprising:

a voltage converter for supplying power to an electrical load, the voltage converter comprising:

an input to receive an input voltage;

an output electrically connected to a series circuit comprising the electrical load and a current sink;

wherein the voltage converter is configured to generate an output voltage at the output that is dependent on the input voltage and on a first multiplication factor; and wherein the series circuit is electrically connected to a reference potential;

a prediction unit comprising:

a first sampling input for receiving a signal derived from the input voltage;

wherein the prediction unit is configured to determine a predicted current sink voltage based on a second multiplication factor obtained from a set of selectable values, based on a load voltage across the electrical load, based on a correction voltage for the voltage converter, and based on the signal derived from the input voltage; and a comparator electrically connected to the prediction unit for receiving the predicted current sink voltage, the comparator comprising an output electrically connected to a control input of the voltage converter, the comparator being configured to compare the predicted current sink voltage with a predetermined threshold value and to output the second multiplication factor to the voltage converter if the predicted current sink voltage exceeds the predetermined threshold value.

2. The arrangement of claim 1, wherein the prediction unit is configured to determine the predicted current sink voltage, $U_{SINK_NEW}$, as follows:

$$U_{SINK_NEW}=U_{IN}\cdot m_{NEW}-U_{LOAD}-U_{CORR_NEW}$$

where $m_{NEW}$ is the second multiplication factor, $U_{IN}$ is the input voltage, $U_{LOAD}$ is the load voltage, and $U_{CORR_NEW}$ is the correction voltage corresponding to the second multiplication factor $m_{NEW}$.

3. The arrangement of claim 1, further comprising:

a second series circuit, the second series circuit comprising a second electrical load and a second current sink, the second series circuit comprising a first electrical connection to the output of the voltage converter and comprising a second electrical connection connected to the reference potential;

wherein the prediction unit is configured to determine a second predicted current sink voltage based on the first multiplication factor, based on a second load voltage corresponding to the second electrical load, based on the correction voltage, and based on the input voltage; and wherein the comparator is configured to compare the second predicted current sink voltage with a second threshold value and to output the second multiplication factor to the voltage converter if the predicted current sink voltage exceeds the predetermined threshold value and the second predicted current sink voltage exceeds the second threshold value, the second threshold value being predetermined.

4. The arrangement of claim 1, wherein the comparator is configured to set the second multiplication factor to a lowest of the selectable values in a case where the predicted current sink voltage for no electrical load is less than or equal to a predetermined threshold value associated with the electrical load.

5. The arrangement of claim 1, wherein the comparator is configured to output a higher multiplication factor to the voltage converter if, and so long as, a present current sink voltage for the electrical load is lower than the predetermined threshold value associated with the electrical load.

6. The arrangement of claim 1, wherein the comparator is configured to identify a falling input voltage, a falling output voltage, or connection of at least one series circuit; and wherein the comparator is configured to trigger prediction regarding whether a higher multiplication factor needs to be set.

7. The arrangement of claim 1, wherein the comparator is configured to identify a rising input voltage, a rising output voltage, or disconnection of the series circuit; and wherein the comparator is configured to trigger prediction regarding whether a lower multiplication factor needs to be set.

8. The arrangement of claim 1, wherein the voltage converter comprises a charge pump.

9. The arrangement of claim 1, wherein the comparator is configured to determine if the series circuit is faulty; and wherein the series circuit is faulty if a present current sink voltage for a highest multiplication factor from the set of selectable values is lower than the predetermined threshold value.

10. The arrangement claim 9, wherein the comparator comprises storage to store information regarding whether the series circuit is faulty.

11. The arrangement of claim 9, wherein the comparator comprises a control output that is electrically connected to the current sink, and wherein the current sink is disconnectable in order to disconnect the current sink if the series circuit is faulty.

12. A method for supplying power to an electrical load, the method being used with a voltage converter comprising an input electrically connected to an input voltage, and comprising an output electrically connected to a first connection of a series circuit, the series circuit comprising an electrical load and a current sink, the series circuit being electrically connected, at a second connection, to a reference potential, the method comprising:

the voltage converter outputting, to the series circuit, an output voltage that is based on the input voltage and on a first multiplication factor;

determining a predicted current sink voltage based on a new multiplication factor obtained from a set of selectable values, based on a signal derived from the input voltage, based on a load voltage across the electrical load, based on a correction voltage;

comparing the predicted current sink voltage with a predetermined threshold value; and outputting the new multiplication factor to a control input of the voltage converter if the predicted current sink voltage exceeds the predetermined threshold value.

13. The method of claim 12, wherein the predicted current sink voltage, $U_{SINK_NEW}$ is determined as follows:

$$U_{SINK_NEW}=U_{IN}\cdot m_{NEW}-U_{LOAD}-U_{CORR_NEW}$$

where $m_{NEW}$ is the new multiplication factor, $U_{IN}$ is the input voltage, $U_{LOAD}$ is the load voltage, and $U_{CORR_NEW}$ is the correction voltage for the new multiplication factor $m_{NEW}$.

14. The method of claim 12, wherein the new multiplication factor is a lowest multiplication factor from the set of selectable values for which the predicted current sink voltage for no electrical load is less than or equal to the predetermined threshold value.

15. The method of claim 12, wherein the new multiplication factor is a higher multiplication factor than a presently set multiplication factor for the voltage converter if, and so long as, a present current sink voltage for the electrical load is lower than the predetermined threshold value.

16. The method of claim 12, wherein the series circuit is identified as faulty if a present current sink voltage for a highest multiplication factor from the set of selectable values remains below the predetermined threshold value.

17. The method of claim 12, further comprising determining whether a higher multiplication factor is to be set based on a falling input voltage, establishing a connection to one or more series circuits, or a falling output voltage.

18. The method of claim 12, further comprising determining whether a higher multiplication factor is to be set based on a rising input voltage, disconnection of one or more series circuits, or a rising output voltage.

19. The method of claim 12, further comprising:

electrically connecting the output of the voltage converter to a second series circuit comprising a further electrical load and a further current sink, the second series circuit being electrically connected to the reference potential;

determining a further predicted current sink voltage based on the new multiplication factor, based on a further load voltage, based on the correction voltage, and based on the signal derived from the input voltage;

comparing the further predicted current sink voltage with a further predetermined threshold value that is associated with the further electrical load; and outputting the new multiplication factor if the predicted current sink voltage exceeds the predetermined threshold value and the further predicted current sink voltage exceeds the further predetermined threshold value.

20. The method of claim 19, further comprising storing information regarding which series circuit is faulty.

21. The method of claim 19, further comprising taking into account only series circuits that are not faulty in setting a multiplication factor and identifying faults.

22. The method of claim 19, further comprising:

disconnecting a current sink of a series circuit identified as being faulty.

* * * * *

UNITED STATES PATENT AND TRADEMARK OFFICE

CERTIFICATE OF CORRECTION

PATENT NO. : 7,898,188 B2
APPLICATION NO. : 11/908723
DATED : March 1, 2011
INVENTOR(S) : Tobias Buehler et al.

It is certified that error appears in the above-identified patent and that said Letters Patent is hereby corrected as shown below:

On the title page, item [54] and column 1, line 1:
Title:
Delete "ARRANGEMENT PROVIDED WITH A VOLTAGE CONVERTER FOR SUPPLYING VOLTAGE TO AN ELECTRICAL CHARGE AND ASSOCIATED METHOD"
And Insert -- ARRANGEMENT INCLUDING A VOLTAGE CONVERTER FOR SUPPLYING POWER TO AN ELECTRICAL LOAD --

Column 12, Claim 7, Line 29;
Insert -- of -- after "arrangement"

Column 12, Claim 12, Line 53;
Insert -- and -- after "load"

Signed and Sealed this
Seventeenth Day of July, 2012

David J. Kappos

David J. Kappos
*Director of the United States Patent and Trademark Office*